US010071830B2

(12) United States Patent
Liu

(10) Patent No.: US 10,071,830 B2
(45) Date of Patent: Sep. 11, 2018

(54) PACKAGING DEVICE WITH ZIPPER OPENER ARRANGEMENT AND HOLE PRESSING ARRANGEMENT

(71) Applicant: Qingdao YiLong Packaging Machinery Co., Ltd., Qingdao (CN)

(72) Inventor: Decheng Liu, Qingdao (CN)

( * ) Notice: Subject to any disclaimer, the term of this patent is extended or adjusted under 35 U.S.C. 154(b) by 519 days.

(21) Appl. No.: 14/730,626

(22) Filed: Jun. 4, 2015

(65) Prior Publication Data

US 2016/0355301 A1 Dec. 8, 2016

(51) Int. Cl.
*B65B 43/30* (2006.01)
*B65B 43/34* (2006.01)
*B65B 61/16* (2006.01)

(52) U.S. Cl.
CPC ..... *B65B 43/30* (2013.01); *B65B 43/34* (2013.01); *B65B 61/16* (2013.01)

(58) Field of Classification Search
CPC ..... B65B 43/26; B65B 43/30; B65B 43/34; B65B 43/465; B65B 61/16; B31B 70/874; Y10T 83/8785; Y10T 83/9425; B26F 1/14
USPC ..... 53/413, 459, 134.1, 570, 384.1, 386.1; 493/227, 372
See application file for complete search history.

(56) References Cited

U.S. PATENT DOCUMENTS 2,754,644 A * 7/1956 Vergobbi et al. ..... B65B 9/042 53/276
3,183,750 A * 5/1965 Davis, Jr. et al. ..... B26F 1/22 493/227
3,196,728 A * 7/1965 Snow ..... B26D 3/12 83/618
3,368,441 A * 2/1968 Piazze ..... B26F 1/12 493/372
4,174,599 A * 11/1979 Callet et al. ..... B65B 43/30 141/75
4,566,252 A * 1/1986 Watanabe et al. ..... B65B 61/16 383/37

(Continued)

FOREIGN PATENT DOCUMENTS

DE 3149809 A1 * 7/1983 ..... B65B 31/06
DE 3639494 A1 * 5/1988 ..... B65B 43/26

(Continued)

*Primary Examiner* — Stephen F Gerrity

(74) *Attorney, Agent, or Firm* — Novoclaims Patent Services LLC; Mei Lin Wong

(57) ABSTRACT

A packaging device includes a supporting base, a zipper opener arrangement and a hole pressing arrangement. The zipper opener arrangement includes a driving unit supported on the supporting base, a first bag opening assembly including a plurality of outer operating members operatively and downwardly extended from the driving unit for selectively clamping the first bag panel, and a second bag opening assembly including a plurality of inner operating members operatively and downwardly extended from the driving unit for selectively clamping the second bag panel. The hole pressing arrangement includes a pressing unit supported by the supporting base, a first securing member supported by the pressing unit, and a second securing member supported by the pressing unit at a position which is spaced apart from the first securing member to form a pressing gap between the first securing member and the second securing member.

8 Claims, 7 Drawing Sheets

(56) References Cited

U.S. PATENT DOCUMENTS

| | | | | | |
|---|---|---|---|---|---|
| 4,617,785 | A * | 10/1986 | Chikatani et al. | B65B 43/34 | 53/562 |
| 5,114,394 | A * | 5/1992 | Madsen | B26D 5/12 | 493/227 |
| 2002/0050126 | A1* | 5/2002 | Koppe | B65B 43/465 | 53/459 |
| 2007/0074492 | A1* | 4/2007 | Koga et al. | B65B 43/34 | 53/512 |
| 2008/0098697 | A1* | 5/2008 | Murray | B65B 43/30 | 53/457 |

FOREIGN PATENT DOCUMENTS

| | | | | |
|---|---|---|---|---|
| FR | 2547794 | A1 * | 12/1984 | B65B 43/30 |
| WO | WO 2013069600 | A1 * | 5/2013 | B26F 1/14 |

* cited by examiner

PACKAGING DEVICE WITH ZIPPER OPENER ARRANGEMENT AND HOLE PRESSING ARRANGEMENT

BACKGROUND OF THE PRESENT INVENTION

Field of Invention

The present invention relates to a packaging device, and more particularly to a packaging device which comprises a zipper opener arrangement and a hole pressing arrangement for effectively and efficiently opening a bag and pressing a hole in the bag in a packaging process.

Description of Related Arts

In a typical packaging process, bags, such as zipper bags may need to be opened for putting filler materials in the bags. There is a major difficulty in effectively and efficiently opening a zipper bag by a typical packaging machine. A typical zipper bag usually has a zipper and two flaps formed on top of the zipper. Since the flaps of the zipper bags usually stick with each other, it can be very difficult for a typical suction device to separate the two flaps and open the zipper bag. The difficulty in opening a zipper bag in a typical packaging process may adversely affect the other steps of that process. Ultimately, the overall efficiency and effectiveness of the packaging process will be severely affected.

On the other hand, for the above-mentioned packaging process, the quality of holes formed on a zipper bag is very variable. Moreover, it is extremely difficult for a conventional packaging machine to press a hole on a bag when it has already been sealed. Holes formed on zipper bags couldn't be made by a conventional packaging machine or may be incorrectly positioned, or do not have a clear-cut surrounding edge.

So there is a need to develop a packaging machine which may tackle the above-mentioned problems and which is capable of effectively and efficiently opening a zipper bag and pressing a hole thereon.

SUMMARY OF THE PRESENT INVENTION

An objective of the present invention is to provide a packaging device which comprises a zipper opener arrangement and a hole pressing arrangement for effectively and efficiently opening a bag and pressing a hole in the bag in a packaging process.

In one aspect of the present invention, it provides a packaging device for a zipper bag having a first bag panel, a second bag panel defining a bag opening between the first bag panel and the second bag panel, and a zipper selectively closing and opening the bag opening, the packaging device comprising:

a supporting base;

a zipper opener arrangement, which comprises:

a driving unit supported on the supporting base;

a first bag opening assembly which comprises a plurality of outer operating members operatively and downwardly extended from the driving unit;

a second bag opening assembly which comprises a plurality of inner operating members operatively and downwardly extended from the driving unit; and a hole pressing arrangement, which comprises:

a pressing unit supported by the supporting base, the pressing unit comprising a pressing head;

a first securing member supported by the pressing unit, the first securing member having a first opening; and a second securing member supported by the pressing unit at a position which is spaced apart from the first securing member to form a pressing gap between the first securing member and the second securing member, the second securing member having a second opening, the first opening, the second opening and the pressing head having substantially identical cross sectional shape and being aligned with each other, the pressing head being selectively driven to pass through the first opening and the second opening for pressing a hole on the zipper bag.

In another aspect of the present invention, it provides a zipper opener arrangement for a packaging device having a supporting base, and being used for a zipper bag having a first bag panel having a first upper portion and a first lower portion, a second bag panel having a second upper portion and a second lower portion, and a zipper, the first bag panel and the second bag panel defining a bag opening between the first bag panel and the second bag panel, the zipper selectively closing and opening the bag opening, the zipper opener arrangement comprising:

a driving unit supported on the supporting base;

a first bag opening assembly which comprises a plurality of outer operating members operatively and downwardly extended from the driving unit for selectively clamping the first bag panel; and a second bag opening assembly which comprises a plurality of inner operating members operatively and downwardly extended from the driving unit for selectively clamping the second bag panel.

In another aspect of the present invention, it provides a hole pressing arrangement for a packaging device having a supporting base, and being used for a bag having a first bag panel having a first upper portion and a first lower portion, a second bag panel having a second upper portion and a second lower portion, the first bag panel and the second bag panel defining a bag opening between the first bag panel and the second bag panel, the hole pressing arrangement comprising:

a pressing unit supported by the supporting base, the pressing unit comprising a pressing head;

a first securing member supported by the pressing unit, the first securing member having a first opening; and a second securing member supported by the pressing unit at a position which is spaced apart from the first securing member to form a pressing gap between the first securing member and the second securing member, the second securing member having a second opening, the first opening, the second opening and the pressing head having substantially identical cross sectional shape and being aligned with each other, the pressing head being selectively driven to pass through the first opening and the second opening for pressing a hole on the bag.

DETAILED DESCRIPTION OF THE PREFERRED EMBODIMENT

Figure 1:
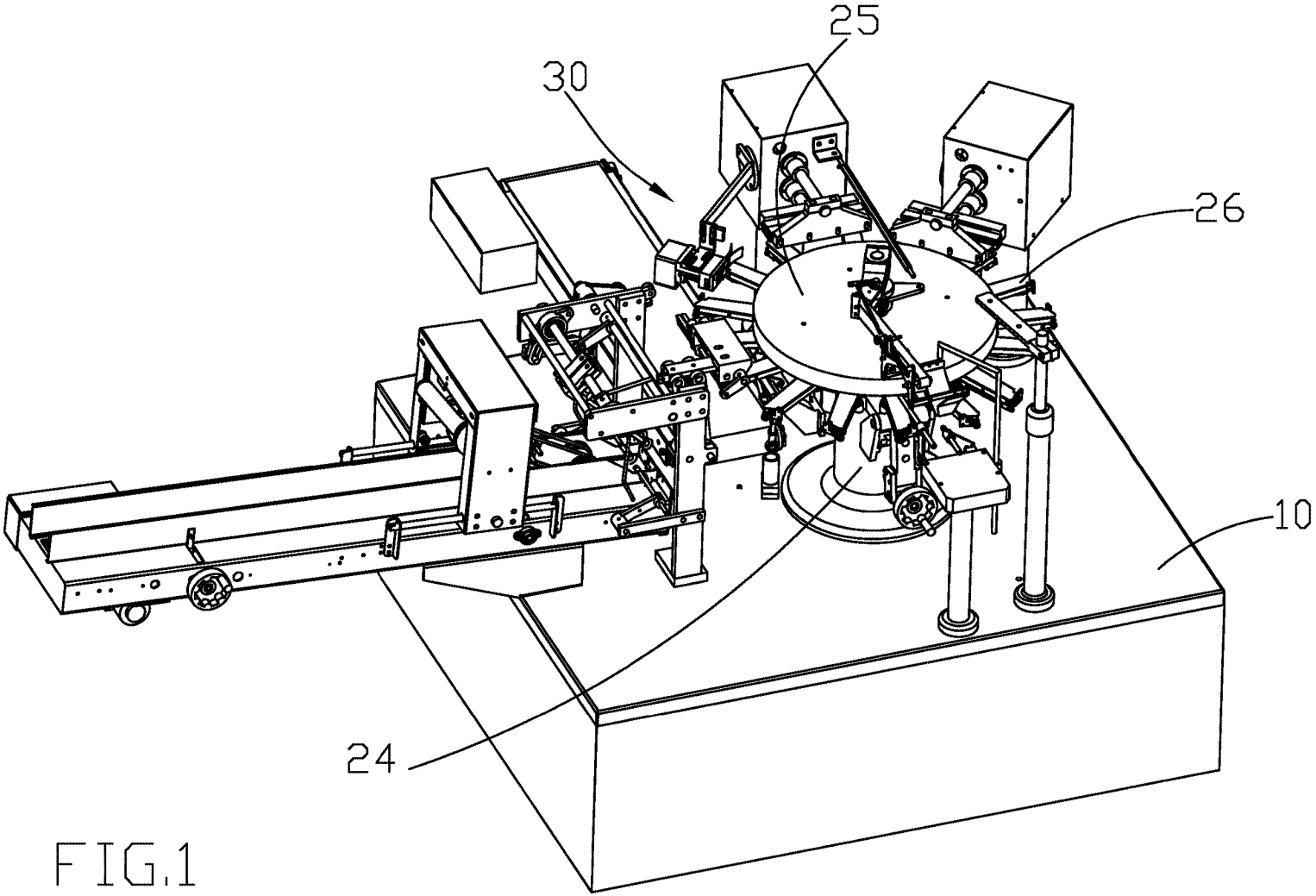
FIG. 1 is a schematic diagram of a packaging device according to a preferred embodiment of the present invention.

Referring to FIG. 1 to FIG. 3, FIG. 4A to FIG. 4C and FIG. 5 to FIG. 6 of the drawings, a packaging device according to a preferred embodiment of the present invention is illustrated. Broadly, the packaging device comprises a supporting base 10, a zipper opener arrangement 20, and a hole pressing arrangement 30. The packaging device is for a zipper bag 80 having a first bag panel 81, a second bag panel 82 defining a bag opening 83 between the first bag panel 81 and the second bag panel 82, and a zipper 84 selectively closing and opening the bag opening 83, and divides the first bag panel 81 into a first upper portion 811 and a first lower portion 812, and the second bag panel 82 into a second upper portion 821 and a second lower portion 822.

The zipper opener arrangement 20 comprises a driving unit 21 supported on the supporting base 10, a first bag opening assembly 22, and a second bag opening assembly 23. On the other hand, the hole pressing arrangement 30 comprises a pressing unit 31, a first securing member 32 and a second securing member 33.

The first bag opening assembly 22 comprises a plurality of outer operating members 221 operatively and downwardly extended from the driving unit 21.

The second bag opening assembly 23 comprises a plurality of inner operating members 231 operatively and downwardly extended from the driving unit 21.

The first bag opening assembly 22 comprises a plurality of outer operating members 221 operatively and downwardly extended from the driving unit 21.

The second bag opening assembly 23 comprises a plurality of inner operating members 231 operatively and downwardly extended from the driving unit 21.

The pressing unit 31 of the hole pressing arrangement 30 is supported by the supporting base 10, and comprises a pressing head 311.

The first securing member 32 is supported by the pressing unit 31, and has a first opening 321. On the other hand, the second securing member 33 is movably supported by the pressing unit 31 at a position which is spaced apart from the first securing member 32 to form a pressing gap 34 between the first securing member 32 and the second securing member 33. The second securing member 33 has a second opening 331, wherein the first opening 321, the second opening 331 and the pressing head 311 has substantially identical cross sectional shape and are aligned with each other, so that the pressing head 311 is arranged to be selectively driven to pass through the first opening 321 and the second opening 331 for pressing a hole on the zipper bag 80.

According to the preferred embodiment of the present invention, the packaging device of the present invention is arranged to carry out different steps in a typical packaging process. The zipper opener arrangement 20 and the hole pressing arrangement 30 are supported by the supporting base 10 with all other components of a typical packaging device. It is worth mentioning that the packaging device is for processing on a zipper bag 80 having the first bag panel 81, the second bag panel 82 and the zipper 84.

Figure 2:
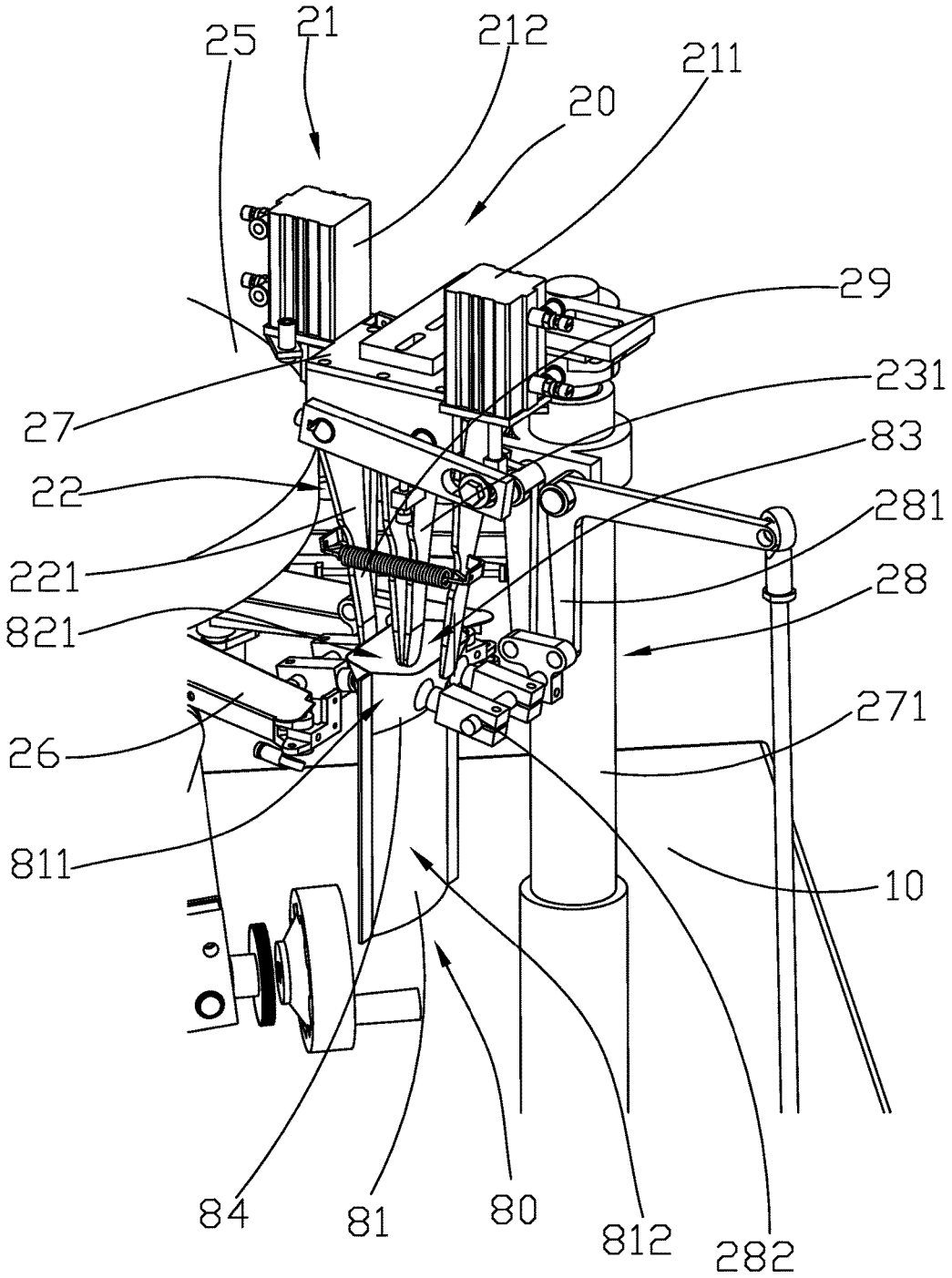
FIG. 2 is a perspective view of the zipper opener arrangement of the packaging device according to the preferred embodiment of the present invention.
Figure 3:
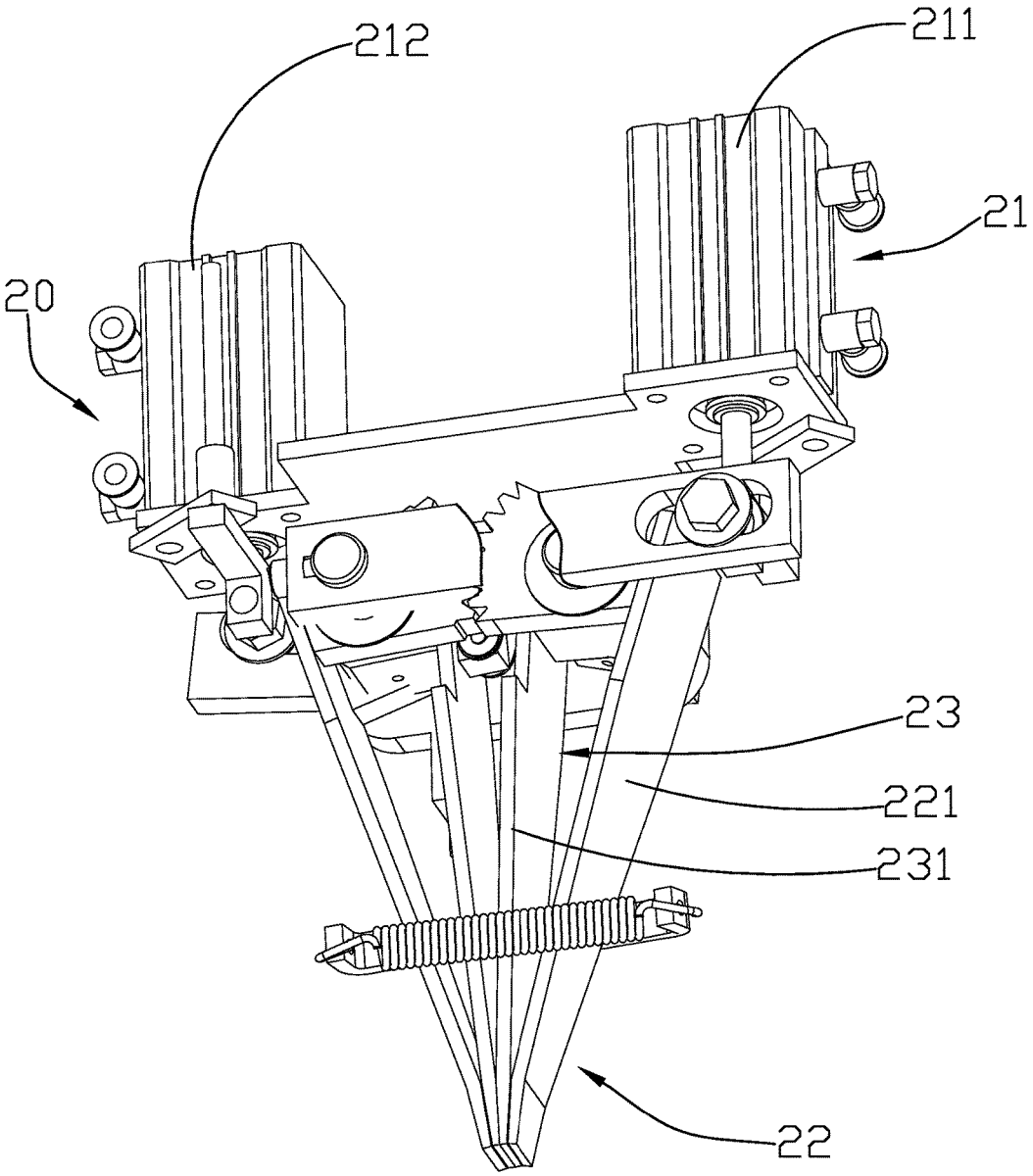
FIG. 3 is a schematic diagram of the zipper opener arrangement of the packaging device according to the preferred embodiment of the present invention.
Figure 4A:
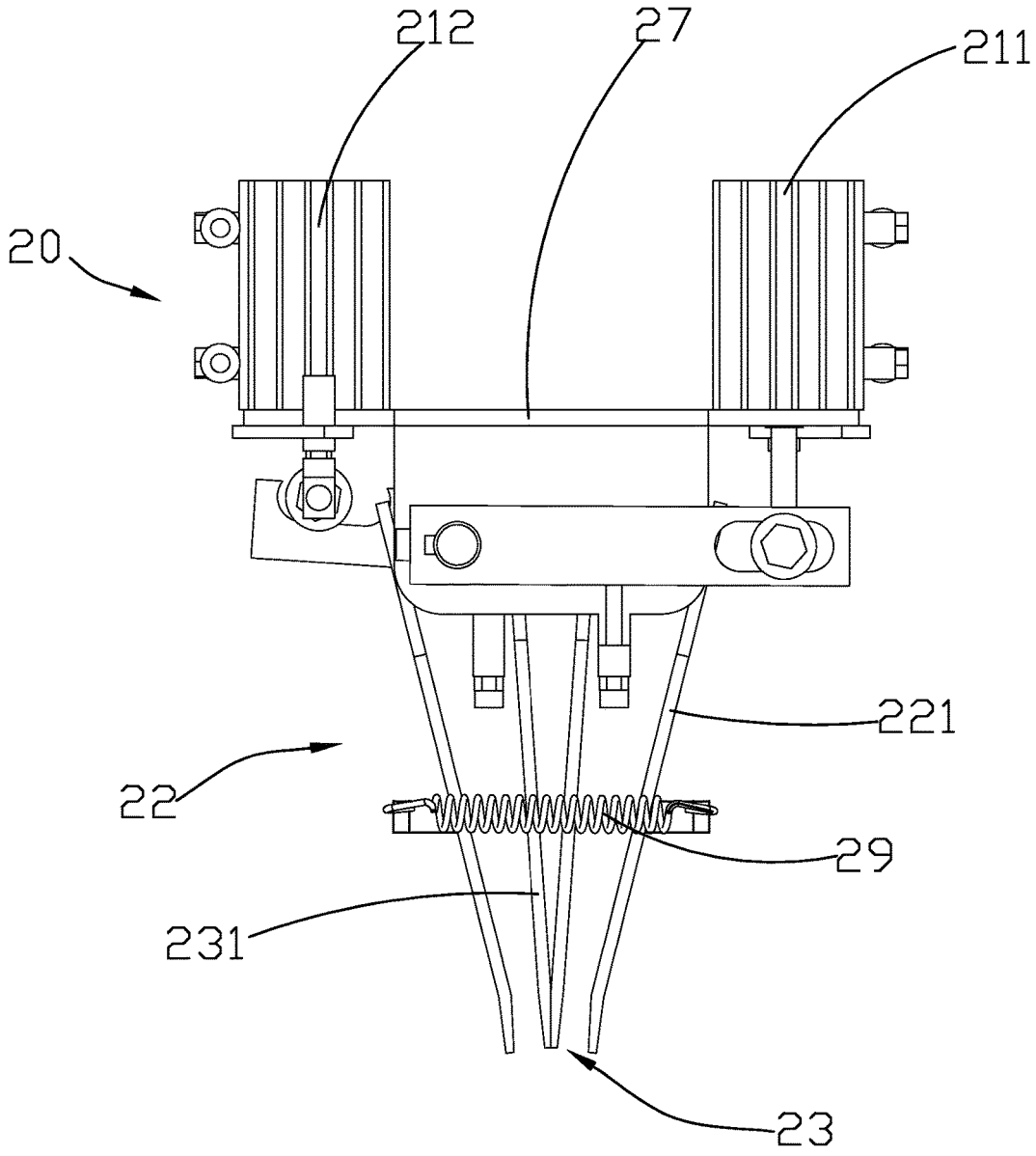
FIG. 4A to FIG. 4C is a schematic diagram of the zipper opener arrangement of the packaging device according to the preferred embodiment of the present invention.
Figure 4C:
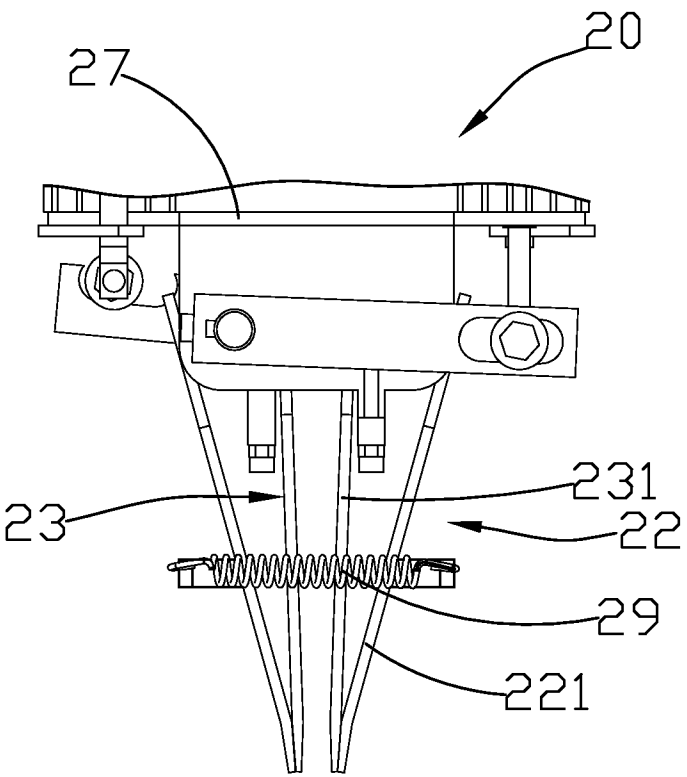
Figure 4B:
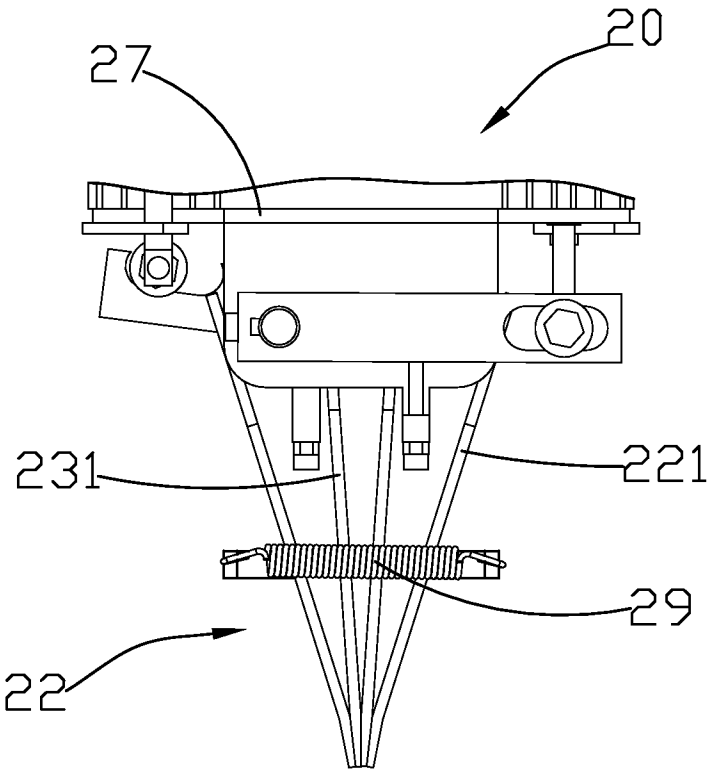

As shown in FIG. 1 to FIG. 2 of the drawings, the zipper opener arrangement 20 further comprises a first supporting stem 24 upwardly extended from the supporting base 10, a rotating plate 25 rotatably supported on the supporting stem 24, at least one supporting arm 26 suspendedly supported by the rotating plate 25 for clamping the first lower portion 812 and the second lower portion 822 of the zipper bag 80. The rotating plate 25 is preferably circular in cross sectional shape. But it can actually configured to have any other cross sectional shapes.

Moreover, the zipper opener arrangement 20 further comprises a supporting platform 27 supported by the supporting base 10, preferably through a reinforcing stem 271, and a plurality of suction devices 28 supported by the supporting platform 27. Each of the suction devices 28 comprises a plurality of connecting arms 281 movably connected to the supporting platform 27, and a pair of suction members 282 movably connected to lower ends of the corresponding connecting arms 281 for detachably sucking the first and the second upper portions 811, 821 of the first bag panel 81 and the second bag panel 82. As shown in FIG. 2 of the drawings, the suction devices 28 are arranged to detachably attached to the first bag panel 81 and the second bag panel 82 of the zipper bag 80 respectively, so that when the suction members 282 are driven to move away from the zipper bag 80, the first upper portion 811 and the second upper portion 821 of the first bag panel 81 and the second bag panel 82 are moved apart from each other for exposing the bag opening 83 and the zipper 84 of the zipper bag 80.

The driving unit 21 comprises a first actuating device 211 and a second actuating device 212 both supported by the supporting platform 27. In this preferred embodiment, the first actuating device 211 and the second actuating device 212 are pneumatically controlled machines which are arranged to drive the outer operating members 221 and the inner operating member 231 to move in a radial direction of the rotating plate 25.

As shown in FIG. 3 and FIG. 4A to FIG. 4C of the drawings, each of the outer operating members 221 of the first bag opening assembly 22 is elongated in structure and is downwardly and inclinedly extended from the supporting platform 27 to form a substantially V-shaped structure. On the other hand, each of the inner operating members 231 of the second bag opening assembly 23 is also elongated in structure and is downwardly and inclinedly extended from the supporting platform 27 to form another V-shaped structure. The inner operating members 231 are extended at a position between the outer operating members 221.

Moreover, the angle of inclination between the inner operating members 231 is smaller than that of the outer operating members 221. The reason for such a difference in inclination angle is that the each of the inner operating members 231 and the outer operating members 221 are driven to move by the driving unit 21 in a horizontal direction or transverse direction such that the corresponding first bag panel 81 or the second bag panel 82 can be received in a space formed between the outer operating member 221 and the corresponding or the adjacent inner operating member 231, so that each of them can be securely clamped by one corresponding outer operating member 221 and one inner operating member 231.

The zipper opener arrangement 20 further comprises a resilient element 29 connected the two outer operating members 221 so as to normally exert a compression force to the two outer operating members 221 for tending to pull them to move towards each other and toward the inner operating member 231.

The operation of the zipper opener arrangement 20 is as follows: the supporting arm 26 is arranged to clamp the first and the second lower portion 821, 822 of the zipper bag 80 so that the zipper bag 80 can be further processed. The supporting arm 26 and the zipper bag 80 in its closed state is rotated by the rotating plate 25 to a predetermined position. The suction device 28 is then actuated to drive the suction members 282 to attach to the first bag panel 81 and the second bag panel 82. The first upper portion 811 and the second upper portion 821 of the first bag panel 81 and the second bag panel 82 are moved apart from each other.

The outer operating members 221 are spaced apart at a predetermined distance in such a manner that the distance is greater than a distance between the first bag panel 81 and the second bag panel 82 when they are moved apart by the suction members 282. The outer operating members 221 are then driven to move downwardly by the reinforcing stem 271 so that the outer operating members 221 stop at a position just adjacent to the first upper portion 811 and the second upper portion 821 but at an exterior side of the first bag panel 81 and the second bag panel 82. At the same time, each of the first upper portion 811 and the second upper portion 821 of the first bag panel 81 and the second bag panel are positioned between the corresponding outer operating member 221 and the inner operating member 231.

The driving force applied to the outer operating members 221 is then released from the driving unit 21. The outer operating members 221 are then subject to the pulling force exerted by the resilient element 29 to bias against the first upper portion 811 and the second upper portion 821.

Afterwards, the driving unit 21 is arranged to drive the inner operating members 231 to move outwardly so as to move apart the first upper portion 811 and the second upper portion 821. Since the outer operating members 221 are normally subject to the pulling force exerted by the resilient element 29, when the inner operating members 231 are driven to move outwardly, each pair of the inner operating member 231 and the outer operating member 221 is arranged to securely clamp the first upper portion 811 or the second upper portion 821 for moving them apart from each other. When the first upper portion 811 and the second upper portion 821 are move apart from each other, the zipper 84 will be eventually opened for allowing access of the cavity in the zipper bag 80.

When the zipper 84 has been opened, the driving unit 21 is arranged to drive the inner operating members 231 to move inwardly. At the same time, the reinforcing stem 271 is arranged to drive the first bag opening assembly 22 and the second bag opening assembly 23 to move upwardly so that they can disengage from the zipper bag 80. The rotating plate 25 is then driven to rotate so as to move the opened zipper bag 80 to the next position so that the packaging device perform the next packaging step on the zipper bag 80. Another zipper bag 80 is then moved to the same position as the original zipper bag 80 for being opened in the manner described above.

It is worth mentioning that the above-mentioned zipper opener arrangement 20 imitates the bag opening mechanism performed by human fingers so as to offer easy and convenient opening of the zipper 84 and the zipper bag 80. The zipper opener arrangement 20 is automatically controlled by a computer and a predetermined program so as that its operation parameters can be easily and optimally adjusted.

Figure 5:
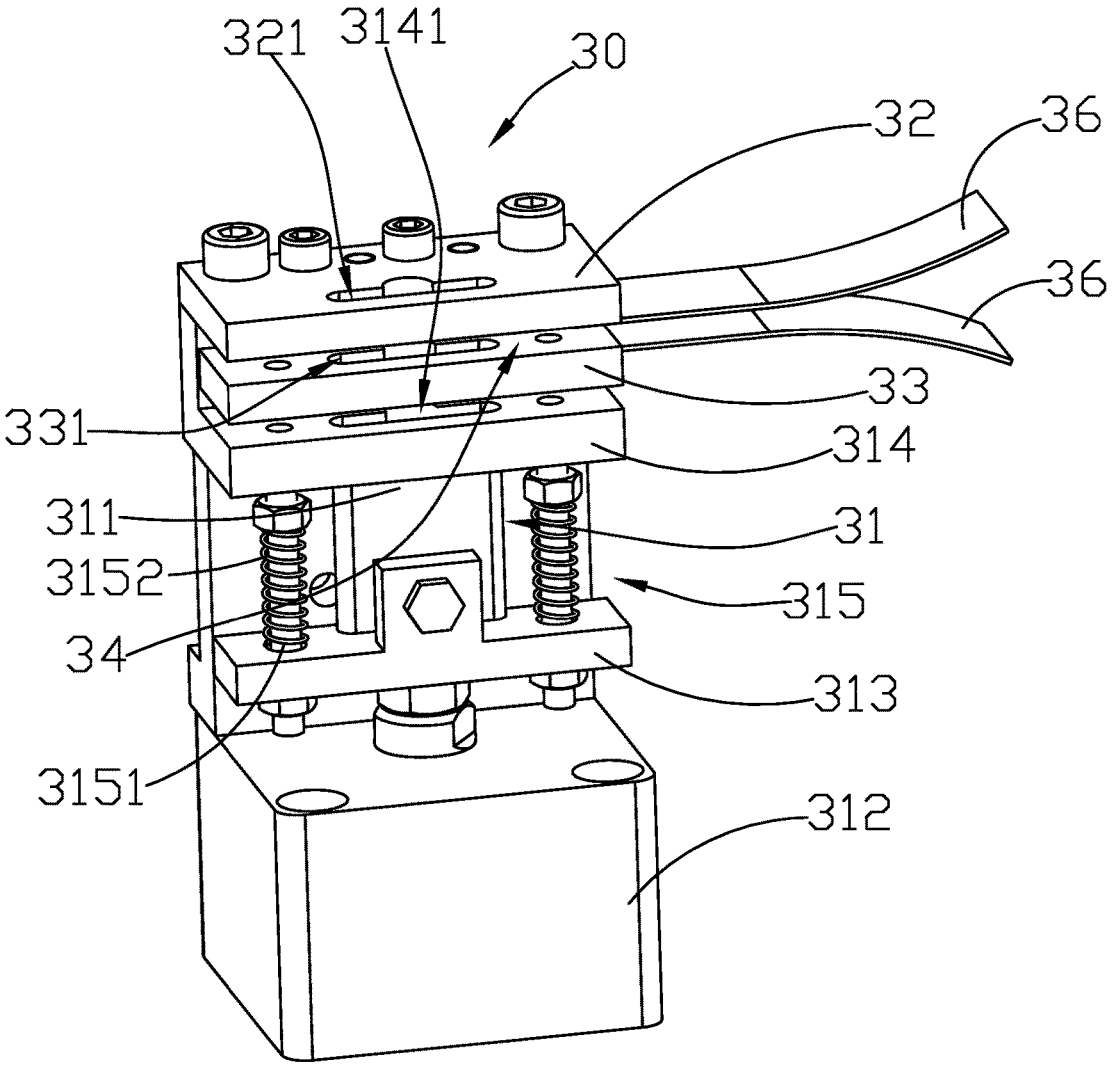
FIG. 5 is a perspective view of a hole pressing arrangement of the packaging device according to the preferred embodiment of the present invention.
Figure 6:
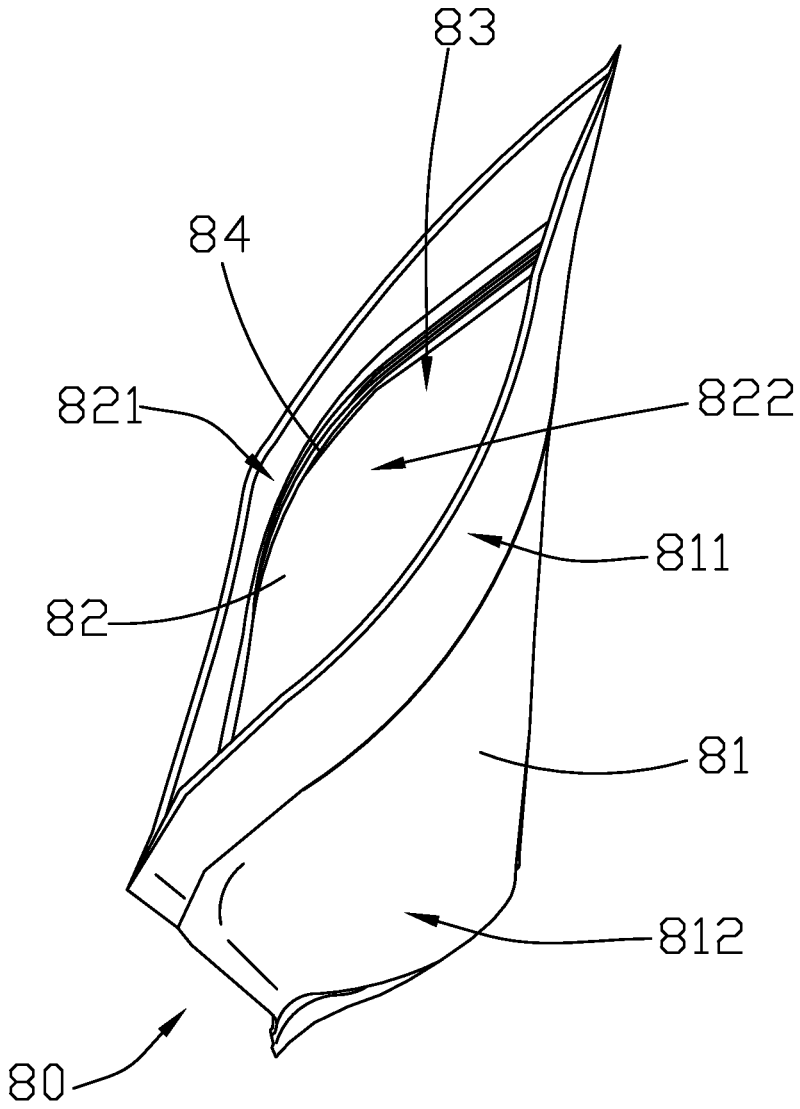
FIG. 6 is a schematic diagram of a zipper bag.

Referring to FIG. 5 of the drawings, the pressing unit 31 of the hole pressing arrangement 30 further comprises an actuation unit 312 which is a pneumatically controlled apparatus, wherein the pressing head 311 is operatively and movably connected to the actuation unit 312 in such a manner that the pressing head 311 is capable of moving away from the actuation unit 312 for pressing a hole on the zipper bag 80.

Moreover, the pressing unit 31 further comprises a main pressing frame 313 supported above the actuation unit 312, a guiding frame 314 supported below the second securing member 33 but above the main pressing frame 313, and a plurality of resilient members 315 connected between the main pressing frame 313 and the guiding frame 314. The pressing head 311 is supported by the main pressing frame 313. The guiding frame 314 has a third opening 3141 which is shaped, sized and positioned to correspond to the first opening 321 and the second opening 331 such that the pressing head 311 is capable of moving through the first opening 321, the second opening 331, and the third opening 3141 for pressing a through hole on the zipper bag 80.

According to the preferred embodiment of the present invention, the first securing member 31 and the guiding frame 314 are integrally connected to form a single structure, wherein the pressing head 311 is arranged to penetrate the guiding frame 314. This structure ensures proper alignment of the first securing member 32, the second securing member 33, the pressing head 311 as guided by the guiding frame 314, and the zipper bag 80.

Accordingly, each of the resilient members 315 comprises a biasing member 3151 and a compressive spring 3152 mounted on the biasing member 3151 for normally exerting a biasing force toward the main pressing frame 313.

The operation of the hole pressing arrangement 30 is as follows: a zipper bag 80 is first transported to the hole pressing arrangement 30 in such a manner that the first upper portion 811 and the second upper portion 821 are sandwiched between the first securing member 32 and the second securing member 33 in the pressing gap 34, preferably through a plurality of guiding plates 36 extended from the first securing member 32 and the second securing member 33 respectively.

When the zipper bag 80 is properly positioned in the pressing gap 34, the pressing head 311 is then driven to pass through the first through third openings 321, 331, 3141 for cutting a hole on the first upper portion 811 and the second upper portion 821 of the zipper bag 80. After the hole has been formed, the pressing unit 31 returns to its original position and the zipper bag 80 is transported by the packaging device to another station for further processing.

It is worth mentioning that the hole pressing arrangement 30 may also be used for pressing holes on a bag without a zipper. Therefore, the packaging device may be used to process bags with or without zippers.

The present invention, while illustrated and described in terms of a preferred embodiment and several alternatives, is not limited to the particular description contained in this specification. Additional alternatives or equivalent components could also be used to practice the present invention.

What is claimed is:

1. A zipper opener arrangement for a packaging device having a supporting base, and being used for a zipper bag having a first bag panel having a first upper portion and a first lower portion, a second bag panel having a second upper portion and a second lower portion, and a zipper, said first bag panel and said second bag panel defining a bag opening between said first bag panel and said second bag panel, said zipper selectively closing and opening said bag opening, said zipper opener arrangement comprising:

a driving unit supported on said supporting base, said driving unit comprising a first actuating device and a second actuating device;

a first bag opening assembly which comprises a plurality of outer operating members operatively and downwardly extended from said driving unit, each of said outer operating members of said first bag opening assembly being elongated in structure, and downwardly and inclinedly extending from a supporting platform to form a substantially V-shaped structure; and a second bag opening assembly which comprises a plurality of inner operating members operatively and downwardly extended from said driving unit, each of said inner operating members of said second bag opening assembly being elongated in structure, and downwardly and inclinedly extending from said supporting platform to form another V-shaped structure, said inner operating members extending at a position between said outer operating members;

a supporting stem upwardly extended from said supporting base, a rotating plate rotatably supported on said supporting stem, and at least one supporting arm suspendedly supported by said rotating plate for clamping said lower portion of said zipper bag; and said supporting platform supported by said supporting base, and a plurality of suction devices each comprising a plurality of connecting arms movably connected to said supporting platform, and a pair of suction members movably connected to lower ends of said corresponding connecting arms for detachably sucking said first and said second upper portions of said first bag panel and said second bag panel, said first actuating device and said second actuating device of said driving unit being supported by said supporting platform, and pneumatically controlled and arranged to drive said outer operating members and said inner operating member to move in a radial direction of said rotating plate.

2. The zipper opener arrangement, as recited in claim 1, wherein an angle of inclination between said inner operating members is smaller than that of said outer operating members.

3. The zipper opener arrangement, as recited in claim 2, further comprising a resilient element connected to said two outer operating members so as to normally exert a force to said two outer operating members for tending to pull said outer operating members to move toward each other and toward said inner operating members.

4. The zipper opener arrangement, as recited in claim 1, further comprising a resilient element connected to said two outer operating members so as to normally exert a force to said two outer operating members for tending to pull said outer operating members to move toward each other and toward said inner operating members.

5. A packaging device for a zipper bag having a first bag panel having a first upper portion and a first lower portion, a second bag panel having a second upper portion and a second lower portion, and a zipper, said first bag panel and said second bag panel defining a bag opening between said first bag panel and said second bag panel, said zipper selectively closing and opening said bag opening, said packaging device comprising:

a supporting base;

a zipper opener arrangement, which comprises:

a driving unit supported on said supporting base, said driving unit comprising a first actuating device and a second actuating device;

a first bag opening assembly which comprises a plurality of outer operating members operatively and downwardly extended from said driving unit;

a second bag opening assembly which comprises a plurality of inner operating members operatively and downwardly extended from said driving unit, each of said outer operating members and said inner operating members being elongated in structure, and downwardly and inclinedly extending from a supporting platform to form a substantially V-shaped structure, an angle of inclination between said inner operating members being smaller than that of said outer operating members; and a resilient element connected to said two outer operating members so as to normally exert a force to said two outer operating members for tending to pull said outer operating members to move toward each other and toward said inner operating members;

a supporting stem upwardly extended from said supporting base, a rotating plate rotatably supported on said supporting stem, at least one supporting arm suspendedly supported by said rotating plate for clamping said lower portion of said zipper bag; and said supporting platform supported by said supporting base, and a plurality of suction devices each comprising a plurality of connecting arms movably connected to said supporting platform, and a pair of suction members movably connected to lower ends of said corresponding connecting arms for detachably sucking said first and said second upper portions of said first bag panel and said second bag panel, said first actuating device and said second actuating device being supported by said supporting platform, and pneumatically controlled and arranged to drive said outer operating members and said inner operating member to move in a radial direction of said rotating plate; and a hole pressing arrangement, which comprises:

a pressing unit supported by said supporting base, said pressing unit comprising a pressing head;

a first securing member supported by said pressing unit, said first securing member having a first opening; and a second securing member supported by said pressing unit at a position which is spaced apart from said first securing member to form a pressing gap between said first securing member and said second securing member, said second securing member having a second opening, said first opening, said second opening and said pressing head having substantially identical cross sectional shape and being aligned with each other, said pressing head being selectively driven to pass through said first opening and said second opening for pressing a hole on said zipper bag.

6. The packaging device, as recited in claim 5, wherein said pressing unit further comprises a main pressing frame supported above said actuation unit, a guiding frame supported below said second securing member and above said main pressing frame, and a plurality of resilient members connected between said main pressing frame and said guiding frame, said pressing head being supported by said main pressing frame.

7. The packaging device, as recited in claim 6, wherein said guiding frame has a third opening which is shaped, sized and positioned to correspond to said first opening and said second opening such that said pressing head is capable of moving through said first opening, said second opening, and said third opening for pressing a through hole on said zipper bag.

8. The packaging device, as recited in claim 7, wherein each of said resilient members comprises a biasing member and a compressive spring mounted on said biasing member for normally exerting a biasing force toward said main pressing frame.

* * * * *